US005135361A

United States Patent [19]

Dion

[11] Patent Number: 5,135,361

[45] Date of Patent: Aug. 4, 1992

[54] PUMPING STATION IN A WATER FLOW SYSTEM

[75] Inventor: Thomas R. Dion, Summerville, S.C.

[73] Assignee: William W. Gotherman, Charlotte, N.C. ; a part interest

[21] Appl. No.: 665,425

[22] Filed: Mar. 6, 1991

[51] Int. Cl.[5] ..... F04B 49/06; F04B 23/06

[52] U.S. Cl. ..... 417/62; 417/2; 417/3; 417/36

[58] Field of Search ..... 417/2, 3, 8, 36, 40, 417/26, 62

[56] References Cited

U.S. PATENT DOCUMENTS

| | | | |
|---|---|---|---|
| 1,049,894 | 1/1913 | Merrill | 417/62 |
| 1,059,409 | 4/1913 | Thomas | 417/3 |
| 1,523,342 | 1/1925 | Hart | 417/62 |
| 2,218,565 | 10/1940 | Vickers . | |
| 4,408,452 | 10/1983 | Isunoda | 417/2 |
| 4,437,811 | 3/1984 | Iwata et al. | 417/8 |

FOREIGN PATENT DOCUMENTS

| | | | |
|---|---|---|---|
| 0013290 | 1/1982 | Japan | 417/2 |

*Primary Examiner*—Richard A. Bertsch
*Assistant Examiner*—David W. Scheuermann
*Attorney, Agent, or Firm*—Shefte, Pinckney & Sawyer

[57] ABSTRACT

A water flow system for collecting and discharging waste water, storm water and the like includes a water pumping station into which water is delivered through an inflow main and from which water is pumped through a water discharge main. The pumping station has a water collection well, a pair of water pumps and a conduit arrangement by which the suction side of each pump is communicated with the well and the pressure side of each pump is communicated with the discharge main. A secondary conduit also communicates the pressure side of one pump with the suction side of the other pump. A control system is operative to actuate one of the pumps for normal pumping conditions and to actuate both pumps during periods of heavy water inflow to the station, the secondary conduit providing serial flow of water through the pumps under such conditions to substantially increase the water outflow rate from the pumping station in comparison to conventional parallel combined operation of the pumps.

15 Claims, 6 Drawing Sheets

FIG. 5
FIG. 4
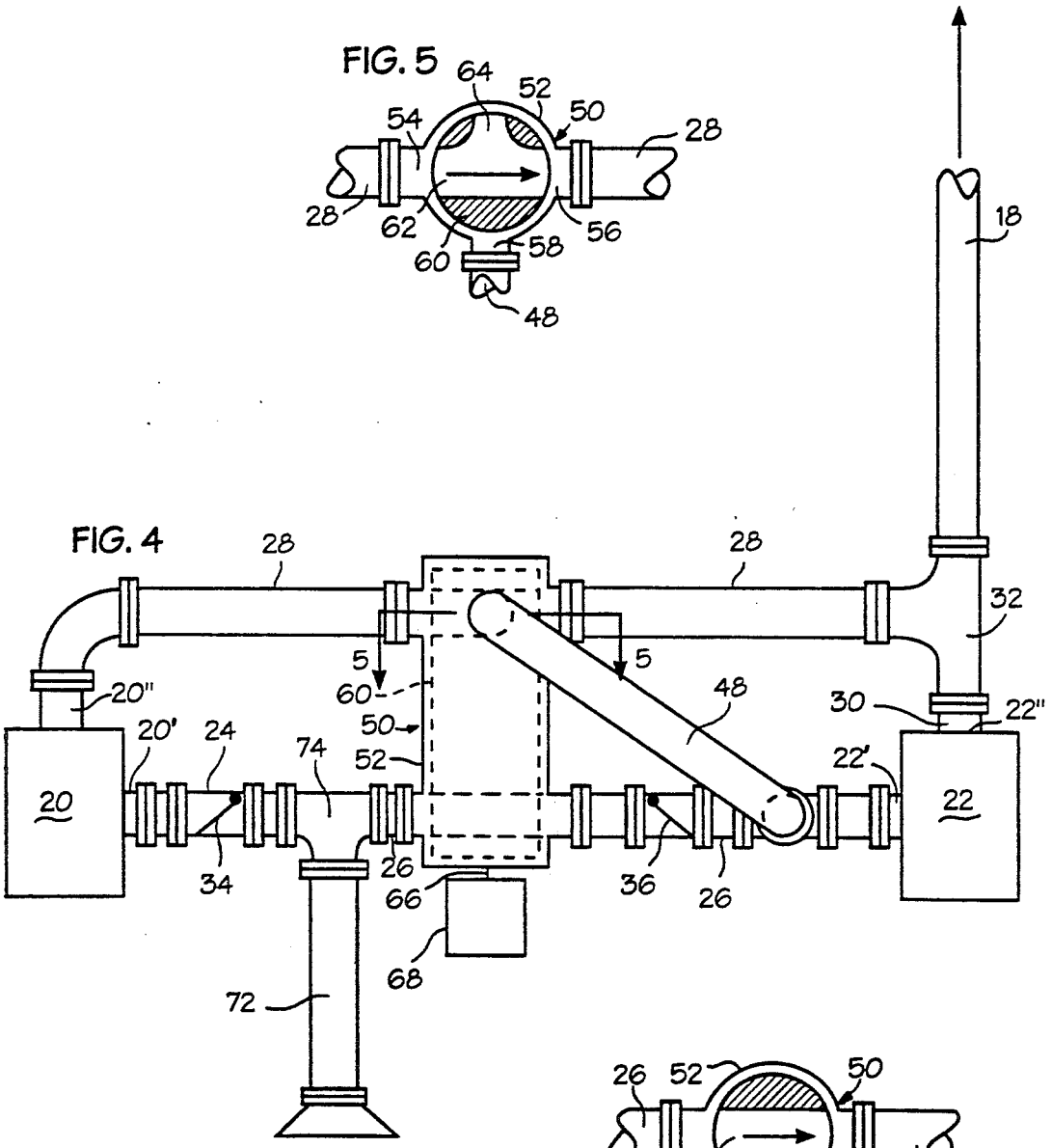
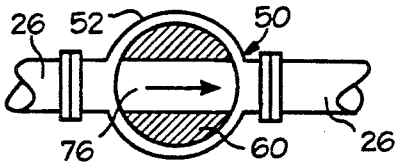
FIG. 6

PUMPING STATION IN A WATER FLOW SYSTEM

BACKGROUND OF THE INVENTION

The present invention relates generally to water flow systems such as for collecting and discharging waste water, storm water and the like, especially wherein water inflow rates may fluctuate widely and unpredictably. More particularly, the present invention relates to a pumping station adapted for use in such water flow systems to effectively discharge widely fluctuating inflows of water.

In water handling systems for conveying waste water, storm water and the like to a treatment station, it is common practice to provide a water pumping station with two pumps of equal size and pumping capacity equivalent at least to a predetermined maximum anticipated head for the water flow system to provide the pumping station with a so-called redundant pumping ability as a safeguard against pump malfunction. That is, even in the event of a malfunction of one of the pumps, the capacity of the remaining pump would still fully satisfy the expected pumping demands placed on the pumping station. In such pumping stations, the pumps are commonly installed in a parallel configuration to permit alternative operation of the pumps, while the non-operating pump remains idle, so that each pump is exercised on a systematic basis. As a guard against unexpected rates of inflowing water, such as may be the result of unusually high storm water or waste water inflows from excessive rain, batch waste water discharges and discharges from pretreatment facilities, etc., a high water indicator and switching arrangement may be provided to detect rates of water inflow exceeding the outflowing capacity of a single operating pump and, in turn, to actuate the idle pump to operate in parallel with the initially-actuated pump to increase the overall pumping capacity of the pumping station.

Disadvantageously, however, the increase in pumping capacity achieved by operating both pumps in parallel is relatively small in relation to the pumping capacity of a single pump. Thus, on such occasions, it is not unusual for such water pumping stations, even when both pumps are operating simultaneously, to be incapable of discharging water as rapidly as it inflows, sometimes causing potentially dangerous backups of water in the associated storm water and/or waste water lines feeding the pumping station. One possible solution to this occasional problem is to select the pumps to be of a sufficiently larger size and capacity than the normally anticipated maximum system head so as to provide sufficient additional reserve pumping capacity to handle occasional water inflow rates exceeding the expected maximum system head. However, this approach to the problem would significantly increase the cost of the pumping station and further would result in even greater underutilization of the pumping capacity of the individual pumps during all normal conditions excepting only occasions when water inflow rates exceed the expected maximum system head.

SUMMARY OF THE INVENTION

It is accordingly an object of the present invention to provide an improved pumping station for waste water, storm water and like water flow systems wherein water inflow rates may fluctuate widely and unpredictably, which pumping station is adapted to effectively discharge such widely fluctuating inflows of water.

Briefly summarized, a water flow system according to the present invention basically comprises a water pumping station, with an inflow main for delivering inflowing water to the pumping station and a discharge main for receiving water outflowing from the pumping station. The pumping station includes a water collection well having a basin area for receiving inflowing water from the inflow main, a pair of water pumps each having a suction inlet and a pressure outlet, and a conduit arrangement communicating the suction inlet of each pump with the basin area of the water collection well and communicating the pressure outlet of each pump with the discharge main. The conduit arrangement is provided with diversion means for communicating the pressure outlet of one pump with the suction inlet of the other pump. A control system actuates and deactuates the pumps, the control system including means for detecting water inflowing into the pumping station from the inflow main, means for actuating one pump when the detected water inflow exceeds a predetermined minimum value, and means for additionally actuating the other pump in series with the first-actuated pump when the detected water inflow exceeds a predetermined maximum value for serial flow of water through the pumps to correspondingly increase the rate of water outflow from the pumping station. In this manner, the pumping station is enabled to effectively discharge widely fluctuating inflows of water.

Preferably, the conduit arrangement includes a pair of suction conduits individually communicated respectively with the suction inlets of the pumps, a pair of discharge conduits individually communicated respectively with the pressure outlets of the pumps, means communicating each discharge conduit with the discharge main, and a secondary conduit branching from the discharge conduit communicated with one pump and being communicated with the suction conduit communicated with the other pump for communicating the pressure outlet of the one pump with the suction inlet of the other pump. In some embodiments of the invention, the conduit arrangement may include an openable and closeable valve associated with the secondary conduit. The conduit arrangement may also include, in some embodiments, a primary suction intake conduit communicated directly with the basin area, with each of the pair of suction conduits branching from the primary suction intake conduit.

With the conduit arrangement of the present invention, it is possible to select the pumps to have respective pumping capacities which individually are less than a predetermined maximum head value for the water flow system provided that the combined capacity of the pumps when simultaneously actuated in series exceeds the predetermined maximum system head value. Because the serial operation of the pumps in accordance with the present invention achieves a substantially greater total pumping capacity than a conventional parallel arrangement of the pumps would achieve, this aspect of the present invention enables the pumping station to be equipped with smaller, less expensive pumps of lower individual capacities than would be dictated by conventional teachings and practices, without sacrificing, and indeed in many cases increasing, the overall pumping capacity of the pumping station.

BRIEF DESCRIPTION OF THE DRAWINGS

FIG. 4 is another schematic diagram of a second embodiment of water flow system according to the present invention;

FIG. 5 is a horizontal cross-sectional view of the diversion valve assembly in the water flow system of FIG. 4, taken along line 5—5 thereof;

FIG. 6 is another horizontal cross-sectional view of the diversion valve assembly in the water flow system of FIG. 4, taken along line 6—6 thereof;

DESCRIPTION OF THE PREFERRED EMBODIMENT

Figures 1, 3:
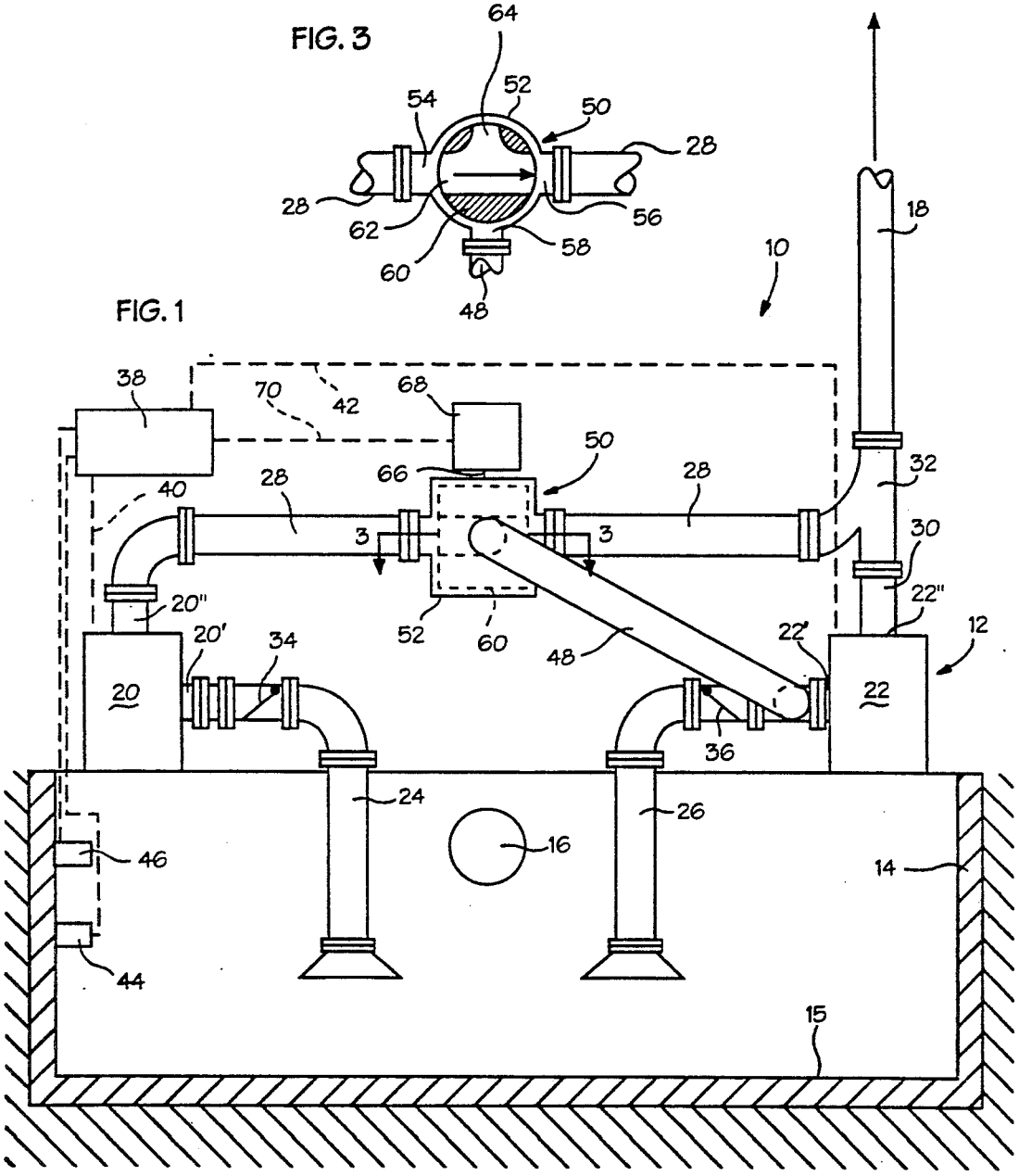
FIG. 1 is a schematic diagram of a water flow system according to the present invention, illustrating one preferred embodiment thereof.
FIG. 3 is a horizontal cross-sectional view of the diversion valve assembly in the water flow system of FIG. 1, taken along line 3—3 thereof.

Referring now to the accompanying drawings and initially to FIG. 1, a water flow system according to the present invention is broadly indicated at 10 and basically includes a water pumping station, generally indicated at 12, having a water collection well 14 into which water, such as storm water, sewage and other waste water, or the like, is delivered through an inflow main 16 and from which the water is then pumped to a downstream treatment, processing or other collection station through a discharge main 18.

The pumping station 12 is equipped with a pair of water pumps 20,22, preferably in the form of centrifugal pumps and preferably identical in construction, operation, size and pumping capacity. Each pump 20,22 has a suction inlet 20',22', respectively, which is individually communicated with a respective suction conduit 24,26 extending downwardly therefrom into a basin area 15 at the bottom of the collection well 14. Each pump 20,22 also includes a pressure discharge outlet 20",22", respectively, which is individually communicated with a respective discharge conduit 28,30 communicated with the discharge main 18, such as through a Y-type or T-type fitting 32. Preferably each suction conduit 24,26 is equipped with a check valve 34,36, respectively, to prevent backflow of water from the respective pump 20,22 into the collection well 14.

Actuation and deactuation of the pumps 20,22 is controlled by a control system which basically includes a central controller 38, which may be of any suitable conventional electromechanical, microprocessor-based, or other type providing equivalent functional capabilities, the controller 38 being individually connected operatively with each pump 20,22, as indicated only schematically at 40,42. Within the collection well 14, a pair of water level sensors or like devices, 44,46, e.g., in the form of float switches, are disposed at differing elevations to detect the level of inflowing water collected in the basin area 15 of the well 14, each water level sensor 44,46 being operatively connected with the controller 38. The water level sensor 44 is disposed at a predetermined elevation within the well 14 above the level of the lower intake ends of the suction conduits 24,26, selected to indicate the level of collected water at which the pumping station 12 should be actuated. The water level sensor 46 is disposed at a predetermined higher elevation within the well 14 selected in relation to the water flow parameters of the overall water flow system 10 to correspond to the water level which would produce the maximum anticipated water pressure head expected to prevail during normal use of the water flow system.

As those persons skilled in the art will recognize, the configuration of the pumping station 12 as thus far described is essentially conventional. As aforementioned, conventional teachings and practices would dictate that each pump 20,22 should be selected to have a pumping capacity in relation to the water flow characteristics of the overall system 10 equivalent to the predetermined maximum water pressure head expected in the system. In such a conventional pumping station configuration, the controller 38 would be arranged or programmed to actuate one of the pumps 20,22 on an alternating basis each time the level of water collected in the well 14 reaches the lower water level sensor 44 and then to deactuate the active pump 20 or 22 when sufficient water has been discharged to lower the level below the sensor 44. The controller 38 would further be conventionally programmed or arranged to actuate the idle pump 20 or 22 if the water level continued to rise in the well 14 to the upper water level sensor 46, thereby to operate both pumps 20 and 22 in parallel relation to one another.

Disadvantageously, this conventional pumping station configuration provides only a relatively small, incremental increase in the overall pumping capacity of the pumping station 12 during parallel operation of the pumps 20,22 in comparison to the pumping capacity of either pump alone. More specifically, assuming that the water flow system 10 has the following flow characteristics in terms of system headloss in feet in relation to the rate of water flow through the system in gallons per minute and assuming further that the pumps 20,22 have the following pumping performance characteristics, individually, in parallel, and in series, respectively, in terms of maximum generatable water flow headloss in feet sustainable at differing rates of water flow through the pump in gallons per minute:

SYSTEM FLOW CHARACTERISTICS

| Flow, GPM | Headloss, FT |
|---|---|
| 0 | 27.03 |
| 100 | 27.57 |
| 200 | 29.01 |
| 300 | 31.25 |
| 400 | 34.28 |
| 500 | 38.07 |
| 600 | 42.60 |
| 700 | 48.11 |
| 800 | 53.84 |
| 900 | 60.47 |
| 1000 | 67.83 |

PUMP PERFORMANCE CHARACTERISTICS

| One Pump | Both Pumps-Parallel: | Both Pumps-Series: |
|---|---|---|

-continued

Figure 2:
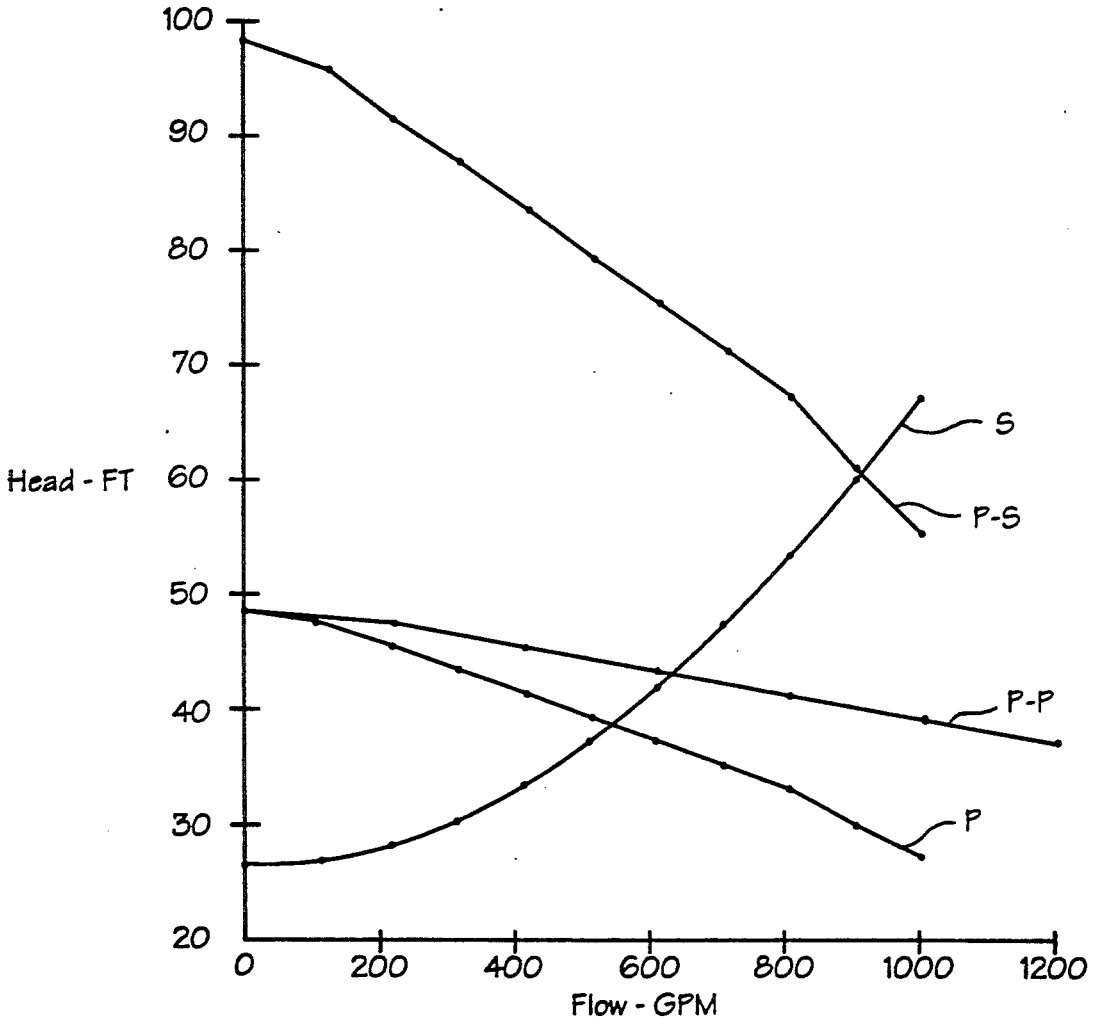
FIG. 2 is a graph comparatively illustrating pump performance curves for the pumps in the water flow system of FIG. 1 when operated individually, in parallel and in series.

| Flow, GPM | Headloss, FT. | Headloss, FT. | Headloss, FT. |
|---|---|---|---|
| 0 | 49 | 49 | 98 |
| 100 | 48 | — | 96 |
| 200 | 46 | 48 | 92 |
| 300 | 44 | — | 88 |
| 400 | 42 | 46 | 84 |
| 500 | 40 | — | 80 |
| 600 | 38 | 44 | 76 |
| 700 | 36 | — | 72 |
| 800 | 34 | 42 | 68 |
| 900 | 31 | — | 62 |
| 1000 | 28 | 40 | 56 |
| 1200 | — | 38 | — |

then it can be seen that the approximate maximum pumping capacity of either pump 20 or 22 when operated individually in the water flow system 10 is about 550 gallons per minute and the maximum pumping capacity of both pumps 20 and 22 when operated simultaneously in parallel to one another in the water flow system 10 is increased only about 23% to approximately 625 gallons per minute, while in contrast simultaneous operation of the pumps 20 and 22 in series with one another in the same water flow system 10 increases their combined pumping capacity over 65% to approximately 910 gallons per minute. The values set forth in the foregoing chart are graphically plotted in FIG. 2 wherein the flow characteristics for the overall water flow system 10 are represented by curve S, the pumping characteristics of either pump 20 or 22 individually are represented by curve P, the pumping characteristics of both pumps 20,22 in parallel are represented by curve P-P, and the pumping characteristics of both pumps 20,22 when operated in series are represented by curve P-S.

The present invention departs from the conventional teachings and practices described above in order to take advantage of the increased pumping capacity of pumps when operated in series as opposed to operation in parallel. More specifically, as illustrated in FIG. 1, the present invention provides a directional flow control valve assembly 50 in the discharge conduit from one of the pumps, e.g., the discharge conduit 28 from the pump 20, which valve assembly 50, in turn, communicates with a secondary flow diversion conduit 48 extending into communication with the suction conduit to the other pump, e.g., the suction conduit 26 to the pump 22. As will be appreciated by those persons skilled in the art, the valve assembly 50 may be of substantially any suitable two-way construction adapted to permit water flow through the discharge conduit 28 to the discharge main 18 while blocking water flow into the secondary conduit 48 or, alternatively, to divert water flow from the discharge conduit 28 into and through the secondary conduit 48 and therefrom through the suction conduit 26 into and through the pump 22.

By way of example, the valve assembly 50 of FIG. 1 is a relatively simple rotary plug-type valve, shown in greater detail in FIG. 3 having aligned inlet and outlet ports 54,56 connected with the incoming and outgoing sections of the discharge conduit 28 and a secondary outlet port 58 equidistant the ports 54,56 to which the secondary conduit 48 is connected. A correspondingly cylindrical valve member 60 is rotatably disposed within the valve body 52, the valve member 60 having a linear passageway 62 extending diametrically therethrough and a branch passageway 64 extending radially outwardly from substantially midway along the length of the passageway 62 in perpendicular relation thereto. A valve stem 66 extends coaxially outwardly from the valve member 60 rotatably through the valve body 52 and is connected to the drive shaft of a control motor 68, which may be of any suitable conventional type and construction adapted for reciprocally rotating the valve member 60 through a 90° range of movement between a first position wherein the linear passageway 62 is aligned with the inlet and outlet ports 54,56 to provide water flow through the discharge conduit 28 and a second position wherein the branch passageway 64 is aligned with the inlet port 54 and the linear passageway 62 is aligned with the outlet port 58 to divert water flow from the discharge conduit 28 into the secondary conduit 48. Actuation of the control motor 68 is controlled by the controller 38 through a suitable connection indicated only at 70.

Normal operation of the pump station 12 according to the present invention may thus be understood. Whenever the water level in the well 14 is below the level of the lower water level sensor 44, the controller 38 maintains both pumps 20,22 in a deactuated idle state. Under normal conditions, the controller 38 acts through the control motor 68 to maintain the valve member 60 in its first aforementioned position for providing water flow through the discharge conduit 28 while blocking water flow into the secondary conduit 48. When water inflow through the main 16 into the well 14 is sufficient to raise the water level within the well 14 above the lower level sensor 44, the controller 38 actuates one of the pumps 20 or 22 to progressively withdraw water from the basin area 15 and pump the water under pressure through the associated discharge conduit 28 or 30 into the discharge main 18, until the level of water in the well 14 is lowered below the level of the sensor 44. For the majority of situations, only one of the pumps 20 or 22 is required to pump inflowing water at a rate greater than the rate of inflow so as to progressively lower the water level within the well 14. The controller 38 may be additionally programmed or arranged to actuate the pumps 20,22 on an alternating basis to insure that each pump is regularly exercised and so that both pumps will have approximately the same useful life, as is conventional.

However, under conditions of relatively high rates of water inflow, such as may be caused by excessive storm water runoff, the rate of water inflow into the well 14 may occasionally exceed the individual pumping capacity of the initially actuated pump 20 or 22, whereby the water level in the well 14 will continue to rise despite the operation of one of the pumps 20,22. To provide for such occasions, the controller 38 is programmed or arranged to simultaneously actuate the control motor 68 to turn the valve member 60 into its second aforementioned position communicating the discharge conduit 28 with the secondary conduit 48 while also actuating the idle pump as soon as the water level in the well 14 reaches the upper level sensor 46. Thus, in such cases the pumps 20,22 are operated in series with one another, substantially increasing their combined pumping capacity so as to best discharge the high inflowing rate of water from the pumping station 12.

As will thus be apparent, a principal advantage of the pumping station 12 under the present invention is a remarkably increased combined pumping capacity of the pumps 20,22 in serial operation as compared to conventional parallel operation. As a result, pumping stations according to the present invention are much less likely than conventional pumping stations to encounter situations in which the combined actuation of the pumps is incapable of fully discharging water as rapidly as it inflows. In turn, the present invention makes it possible to utilize, in any given pumping station, pumps of a smaller size and capacity than would be conventionally necessary because, in many cases, smaller pumps when operated in series will still provide a greater combined pumping capacity for a given water flow system than larger pumps operated in parallel. Since the cost of pumps represents one of the major expenses in the construction of a pumping station, the present invention therefore provides the ability to reduce the overall expense of a pumping station without sacrificing maximum pumping capacity in comparison to conventional pumping stations.

Of course, those persons skilled in the art will readily recognize that pumping stations embodying the principles of the present invention may be of many differing configurations other than that illustrated in FIG. 1 and, accordingly, the present invention is not intended to be limited to such embodiment. By way of example, but without limitation, several other embodiments of pumping stations according to the present invention are depicted in FIGS. 4–9. Since many of the same components in the pumping station 12 of FIG. 1 are utilized in the embodiments of FIGS. 4–9, corresponding components are identified by corresponding reference numerals. Additionally, for sake of simplicity, the water collection well and the pump control system are not illustrated in FIGS. 4–9, but it will be understood by those persons skilled in the art that identical or equivalent components would of course be provided in these alternative embodiments.

Referring first to FIGS. 4–6, the pumping station 112 of this embodiment differs from the pumping station 12 of FIG. 1 in that the suction conduits 24,26 to the pumps 20,22 are communicated to a common primary suction intake conduit 72 through a T-type or other suitable fitting 74, the conduit 72, in turn, communicating directly with the basin area 15 of the water collection well 14. As a result, the valve assembly 50 is configured in this embodiment to also control opening and closing of the suction conduit 26 simultaneously with and in addition to opening and closing of the discharge conduit 28. For example, the valve body 52 and the valve member 60 in this embodiment may be elongated to facilitate connection in both conduits 26,28 and to provide an additional diametric passageway 76 parallel to the passageway 62, but without any associated branch passageway, to operate in conjunction with the suction conduit 26 to open and close such conduit to water flow therethrough each time the valve member 60 is rotated to open and close, respectively, the discharge conduit 28 through the passageway 62. Otherwise, the construction and operation of the pumping station 112 is identical to the above-described pumping station 12.

Figure 7:
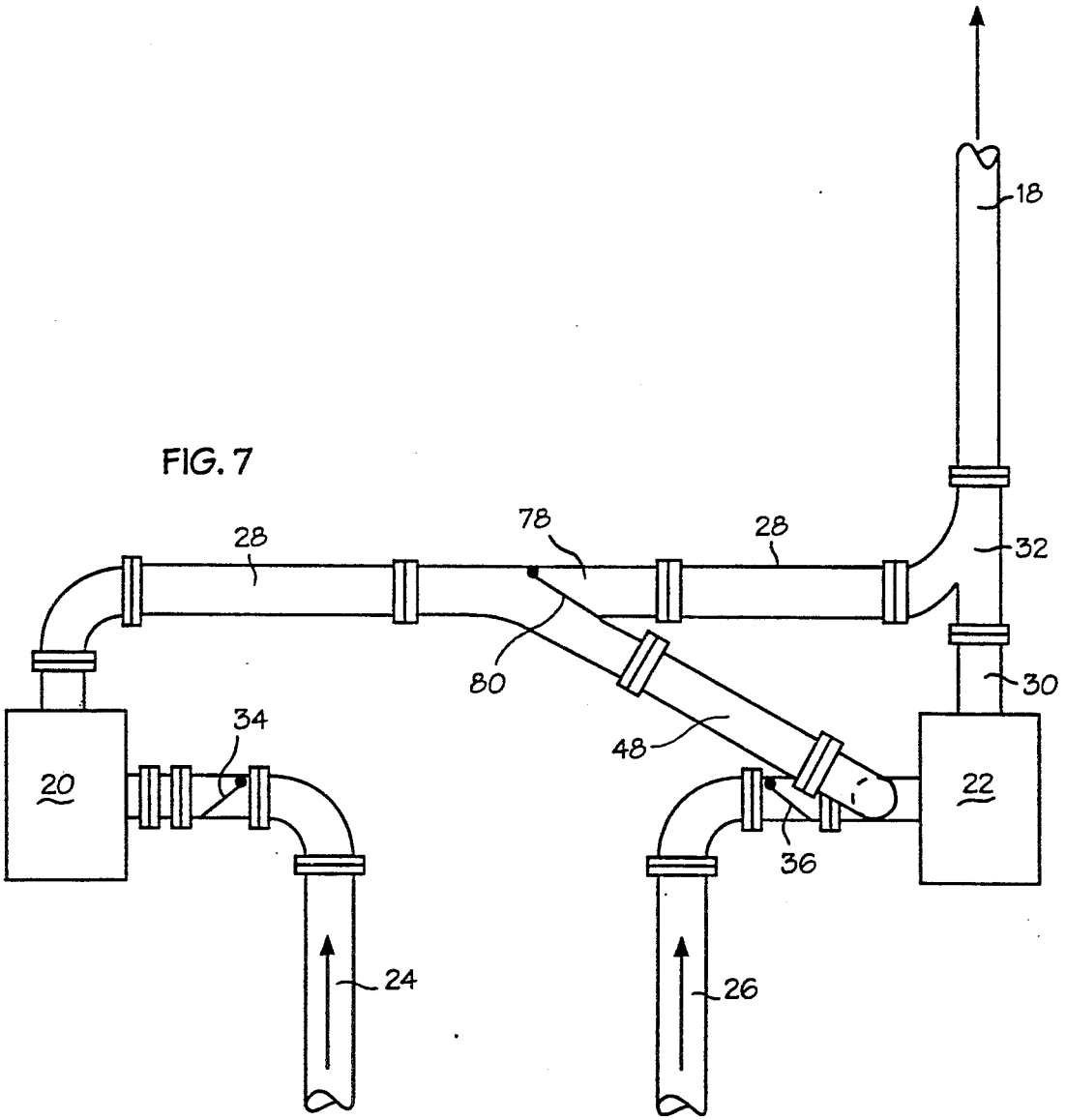
FIG. 7 is another schematic diagram of a third embodiment of water flow system according to the present invention.

FIG. 7 depicts a pumping station 212 which differs from the pumping station 12 of FIG. 1 only in that the valve assembly 50 and its associated control motor 68 are replaced by a wye or Y-type fitting 78 equipped internally with a flapper valve 80 which is biased to normally close the discharge conduit 28 but is openable in response to pressurized water flow from the pump 20 through the discharge conduit 28. Thus, both individual operation of either pump 20 or 22 and serial operation of both pumps 20,22 in combination can proceed in the same manner as described above with regard to the embodiment of FIG. 1. More specifically, when the pump 20 is actuated while the pump 22 remains idle, the pressurized flow of water discharged from the pump 20 into the discharge conduit 28 effectively opens the flapper valve 80 for continued flow of the water through the conduit 28 into the discharge main 18, while the idle pump 22 together with the check valve 36 in its associated suction conduit 26 prevents water flow through the secondary conduit 48 and the communicated suction conduit 26. Similarly, during operation of the pump 22 while the pump 20 remains idle, water drawn from the basin area 15 by the pump 22 tends to follow the path of least resistance into and through the pump 22 and into the discharge main 18, the flapper valve 80 acting in the nature of a check valve to prevent backflow of pressurized water from the discharge main 18 through the discharge conduit 28 while the idle pump 20 and the check valve 34 in its associated suction conduit 24 prevents any tendency of water to backflow through the secondary conduit 48. When the pumps 20,22 are actuated simultaneously, the flapper valve 80 will tend to remain in its normally closed disposition because pressurized water discharged from the pump 20 through the discharge conduit 28 will tend to follow the path of least resistance through the secondary conduit 48 into the suction side of the pump 22 while at the same time pressurized water discharged from the pump 22 will tend to maintain the portion of the discharge conduit 28 downstream of the flapper valve 80 occupied with a sufficient quantity of water to assist in urging the flapper valve 80 into its closed position.

Figure 8:
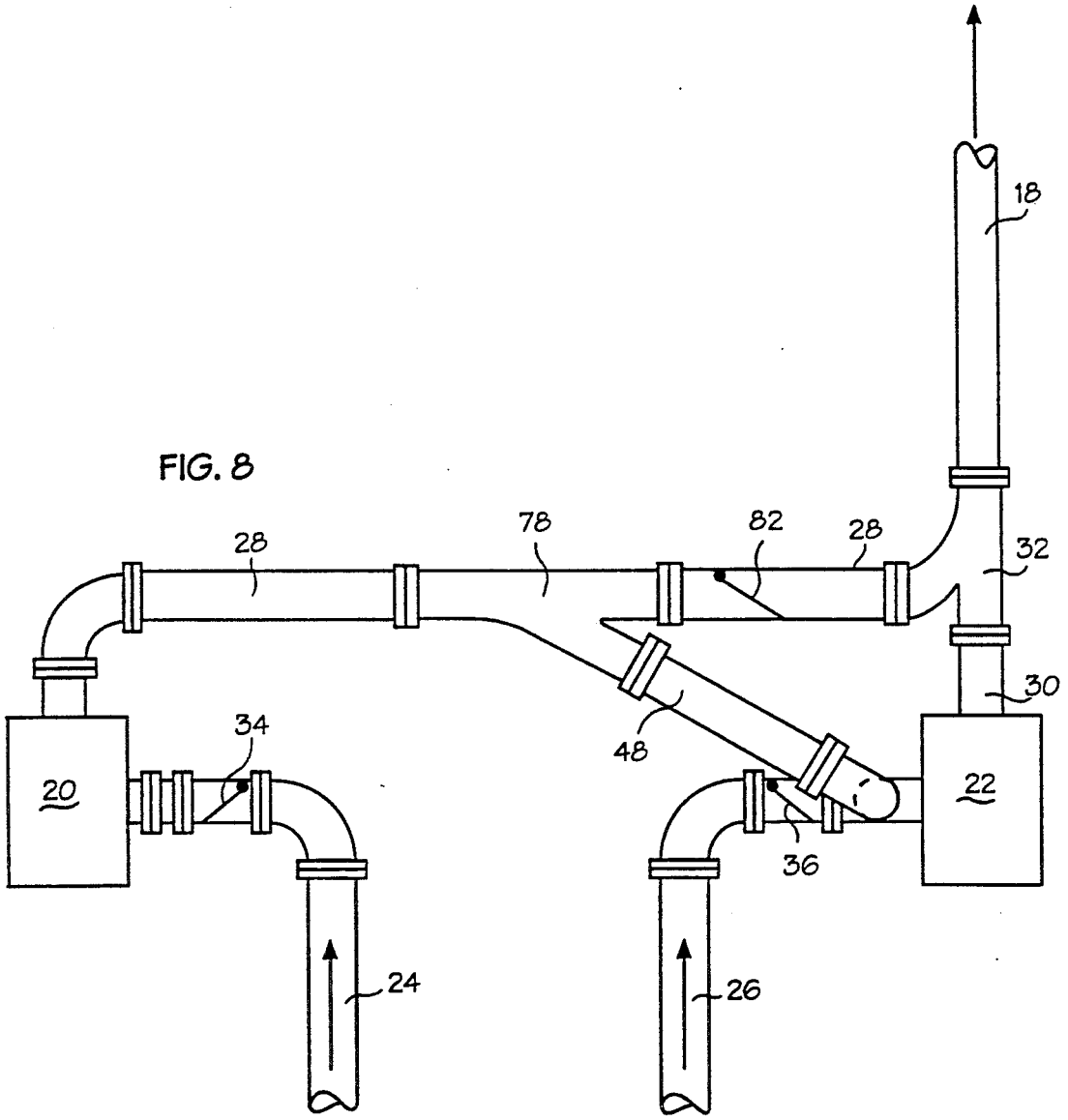
FIG. 8 is another schematic diagram of a fourth embodiment of water flow system according to the present invention.

FIG. 8 illustrates another pumping station 312 which is substantially identical in construction and operation to the pumping station 212 of FIG. 7 except that the wye or Y-type fitting 78 is not equipped with an internal flapper valve 80 and, instead, a check valve 82 is provided in the discharge conduit 28 downstream of the wye fitting to function in essentially the same fashion as the flapper valve 80 in FIG. 7.

Figure 9:
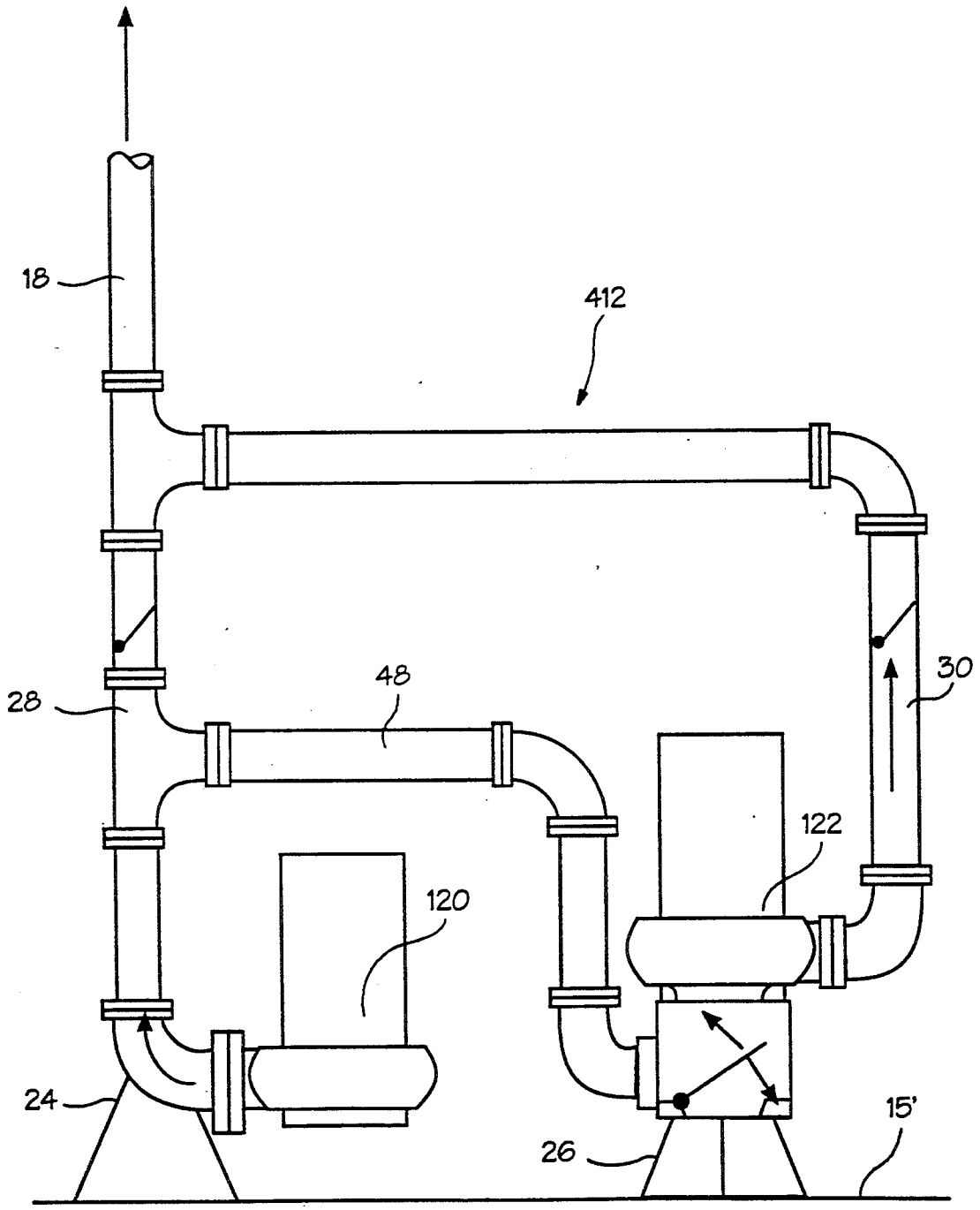
FIG. 9 is another schematic diagram of a fifth embodiment of water flow system according to the present invention.

FIG. 9 illustrates another pumping station 412 similar in configuration to the pumping stations 212 and 312 of FIGS. 7 and 8, except that the pumps 120,122 in this case are of the submergible type and are therefore supported on the basin floor 15' within the collection well 14.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A water flow system for collecting and discharging waste water, storm water and the like wherein water inflow rates may fluctuate widely and unpredictably, said water flow system comprising a water pumping station, an inflow main for delivering inflowing water to said pumping station, and a discharge main for receiving water outflowing from said pumping station, said pumping station comprising a water collection well having a basin area for receiving inflowing water from said inflow main, a pair of water pumps each having a suction inlet and a pressure outlet, conduit means communicating said suction inlet of each said pump with said basin area of said water collection well and communicating said pressure outlet of each said pump with said discharge main, said conduit means including diversion means for communicating said pressure outlet of one said pump with said suction inlet of the other said pump, and control means for actuating and deactuating said pumps, said control means including means for detecting water inflowing into said pumping station from said inflow main, means for actuating one said pump when the detected water inflow exceeds a predetermined minimum value, and means for additionally actuating the other said pump in series with the first-actuated pump when the detected water inflow exceeds a predetermined maximum value for serial flow of water through said pumps to correspondingly increase the rate of water outflow from said pumping station, thereby to enable said pumping station to effectively discharge widely fluctuating inflows of water.

2. A water flow system according to claim 1 and characterized further in that said diversion means includes valve means.

3. A water flow system according to claim 1 and characterized further in that said diversion means includes a secondary conduit for communicating said pressure outlet of said one pump with said suction inlet of said other pump.

4. A water flow system according to claim 3 and characterized further in that said diversion means comprises valve means associated with said secondary conduit.

5. A water flow system according to claim 3 and characterized further in that said conduit means comprises a pair of discharge conduits individually communicated respectively with said pressure outlets of said pumps and means communicating each said discharge conduit with said discharge main, said secondary conduit branching from the discharge conduit communicated with said one pump.

6. A water flow system according to claim 5 and characterized further in that said conduit means comprises a pair of suction conduits individually communicated respectively with said suction inlets of said pumps, said secondary conduit being communicated with the suction conduit communicated with said other pump.

7. A water flow system according to claim 5 and characterized further in that said diversion means comprises valve means associated with said secondary conduit.

8. A water flow system according to claim 6 and characterized further in that said conduit means comprises a primary suction intake conduit communicated directly with said basin area, each of said pair of suction conduits branching from said primary suction intake conduit.

9. A water flow system according to claim 6 and characterized further in that said conduit means comprises a check valve in each said suction conduit.

10. A water flow system according to claim 1 and characterized further in that each said pump is centrifugal pump.

11. A water flow system according to claim 1 and characterized further in that said pumps are selected to have respective pumping capacities which individually are less than a predetermined maximum head valve for said water flow system but which in serial combination upon simultaneous actuation of both said pumps exceed said predetermined maximum system head valve.

12. A water flow system for collecting and discharging waste water, storm water and the like wherein water inflow rates may fluctuate widely and unpredictably, said water flow system comprising a water pumping station, an inflow main for delivering inflowing water to said pumping station, and a discharge main for receiving water outflowing from said pumping station, said pumping station comprising a water collection well having a basin area for receiving inflowing water from said inflow main, a pair of centrifugal water pumps each having a suction inlet and a pressure outlet, conduit means communicating said suction inlet of each said pump with said basin area of said water collection well and communicating said pressure outlet of each said pump with said discharge main, said conduit means including a pair of suction conduits individually communicated respectively with said suction inlets of said pumps, a pair of discharge conduits individually communicated respectively with said pressure outlets of said pumps, means communicating each said discharge conduit with said discharge main, and a secondary diversion conduit branching from the discharge conduit communicated with one said pump and being communicated with the suction conduit communicated with the other said pump for communicating said pressure outlet of said one pump with said suction inlet of said other pump, and control means for actuating and deactuating said pumps, said control means including means for detecting water inflowing into said pumping station from said inflow main, means for actuating one said pump when the detected water inflow exceeds a predetermined minimum value, and means for additionally actuating the other said pump in series with the first-actuated pump when the detected water inflow exceeds a predetermined maximum value for serial flow of water through said pumps to correspondingly increase the rate of water outflow from said pumping station, said pumps being selected to have respective pumping capacities which individually are less than a predetermined maximum head valve for said water flow system but which in serial combination upon simultaneous actuation of both said pumps exceeds said predetermined maximum system head valve, thereby to enable said pumping station to effectively discharge widely fluctuating inflows of water.

13. A water flow system according to claim 12 and characterized further in that said conduit means includes valve means associated with said secondary conduit.

14. A water flow system according to claim 12 and characterized further in that said conduit means comprises a primary suction intake conduit communicated directly with said basin area, each of said pair of suction conduits branching from said primary suction intake conduit.

15. A water flow system according to claim 12 and characterized further in that said conduit means comprises a check valve in each said suction conduit.

* * * * *